US010532276B2

(12) United States Patent
Andrews et al.

(10) Patent No.: US 10,532,276 B2
(45) Date of Patent: Jan. 14, 2020

(54) THREE DIMENSIONAL PUZZLE

(71) Applicant: Giovanni Lavermicocca, Brookvale (AU)

(72) Inventors: Craig Andrews, Kirrbilli (AU); Sacha Pantschenko, Kirrbilli (AU)

( * ) Notice: Subject to any disclaimer, the term of this patent is extended or adjusted under 35 U.S.C. 154(b) by 0 days.

(21) Appl. No.: 15/503,174

(22) PCT Filed: Aug. 11, 2015

(86) PCT No.: PCT/AU2015/000479
§ 371 (c)(1),
(2) Date: Feb. 10, 2017

(87) PCT Pub. No.: WO2016/023066
PCT Pub. Date: Feb. 18, 2016

(65) Prior Publication Data

US 2017/0225067 A1 Aug. 10, 2017

(30) Foreign Application Priority Data

Aug. 11, 2014 (AU) ..... 2014903133

(51) Int. Cl.
*A63F 9/12* (2006.01)

(52) U.S. Cl.
CPC ..... *A63F 9/12* (2013.01); *A63F 2009/122* (2013.01); *A63F 2009/124* (2013.01); *A63F 2009/1232* (2013.01)

(58) Field of Classification Search
CPC ..... A63F 9/12; A63F 2009/122; A63F 2009/124; A63F 2009/1232
See application file for complete search history.

(56) References Cited

U.S. PATENT DOCUMENTS 245,533 A * 8/1881 McChesney ..... A63F 9/12 273/160
2,201,724 A * 5/1940 Gable ..... A63F 9/12 273/157 R (Continued)

FOREIGN PATENT DOCUMENTS

GB 1288320 9/1972
WO WO 83/01203 4/1983

(Continued)

OTHER PUBLICATIONS

Merriam Webster "Definition of Underside", retrieved on Nov. 10, 2018, <<https://www.merriam-webster.com/dictionary/underside>>.*

(Continued)

*Primary Examiner* — Steven B Wong

(57) ABSTRACT

A three dimensional puzzle (10) is disclosed. Puzzle (10) has having a plurality of three dimensional first components (12, 14, 16, 18, 20, 22 and 24) for engagement to form a three-dimensional finished shape (10), each of the three-dimensional first components (12, 14, 16, 18, 20, 22 and 24) being shaped for interlocking engagement with at least one other of the three-dimensional first components (12, 14, 16, 18, 20, 22, 24). At least one of the three-dimensional first components (20, 22, 24) is made in two parts (20*a*, 20*b*, 22*a*, 22*b*, 24*a*, 24*b*) adapted to be joined together by engagement different from the interlocking engagement. Also disclosed is a three dimensional puzzle (10) in which the three-dimensional finished shape (10) has an outer surface containing a three-dimensional pattern (52), which can enhance optional overmolding.

22 Claims, 9 Drawing Sheets

(56) References Cited

U.S. PATENT DOCUMENTS 2,574,158 A 11/1951 Sullivan
2,712,447 A 7/1955 Steinhardt
2,839,841 A * 6/1958 Berry ..... A63H 33/04 273/157 R
3,564,735 A * 2/1971 Fisher ..... A63F 9/12 273/157 R
4,452,454 A * 6/1984 Greene ..... A63F 9/0857 273/153 S
5,230,508 A * 7/1993 Tabler ..... A63F 9/10 273/157 R
5,389,063 A * 2/1995 Wu ..... A61H 7/001 273/153 S
5,409,227 A 4/1995 Walker
5,452,895 A 9/1995 Ray
5,575,476 A * 11/1996 Yang ..... A63F 9/0842 273/153 S
5,816,571 A * 10/1998 Chen ..... A63F 9/0857 273/153 S
5,826,873 A 10/1998 Lavermicocca
5,836,584 A * 11/1998 Chen ..... A63F 9/0857 273/153 S
5,895,044 A * 4/1999 Bahramian ..... A63F 9/1288 273/156
6,050,566 A 4/2000 Shameson
6,056,148 A * 5/2000 Ferguson ..... A63H 33/00 220/297
6,095,521 A * 8/2000 Patel ..... A63F 9/12 273/156
6,601,849 B1 * 8/2003 Konkle ..... A63F 9/12 273/156
6,655,685 B2 * 12/2003 Tsai ..... A63F 9/12 273/156
6,857,632 B2 * 2/2005 Tanner ..... A63F 9/0857 273/153 S
7,063,587 B1 * 6/2006 Lin ..... A63H 33/086 273/156
7,198,270 B1 * 4/2007 Bishop ..... A63F 9/12 273/153 S
D591,951 S * 5/2009 Peters ..... D3/295
7,976,024 B1 7/2011 Stapleton
7,988,516 B2 * 8/2011 Bishop ..... A63H 33/082 446/108
7,988,517 B2 * 8/2011 Bishop ..... A63H 33/082 446/108
D645,911 S * 9/2011 Kock ..... D21/479
8,109,515 B2 * 2/2012 Fedoseyev ..... A63F 9/0861 273/153 R
2007/0194525 A1 * 8/2007 Chuang ..... A63F 9/1208 273/153 R
2008/0280522 A1 11/2008 Bishop
2010/0032897 A1 * 2/2010 Moran ..... A63F 9/1288 273/156

FOREIGN PATENT DOCUMENTS

WO WO95/34354 12/1995
WO WO 2013/097872 7/2013

OTHER PUBLICATIONS

PCT/AU2015/000479, International Search Report and Written Opinion, dated Nov. 17, 2016, 7 pages—English.
PCT/AU2015/000479, Demand dated Jun. 10, 2016. 8 pages—English.
PCT/AU2015/000479, Demand dated Oct. 17, 2016, 6 pages—English.
PCT/AU2015/000479, Supplementary European Search Report dated Mar. 21, 2018, 8 pages—English.
JP 2017-527952, Notice of Reasons for Rejection dated May 20, 2019, 6 pages—English, 3 pages—Japanese.

* cited by examiner

Figure 3
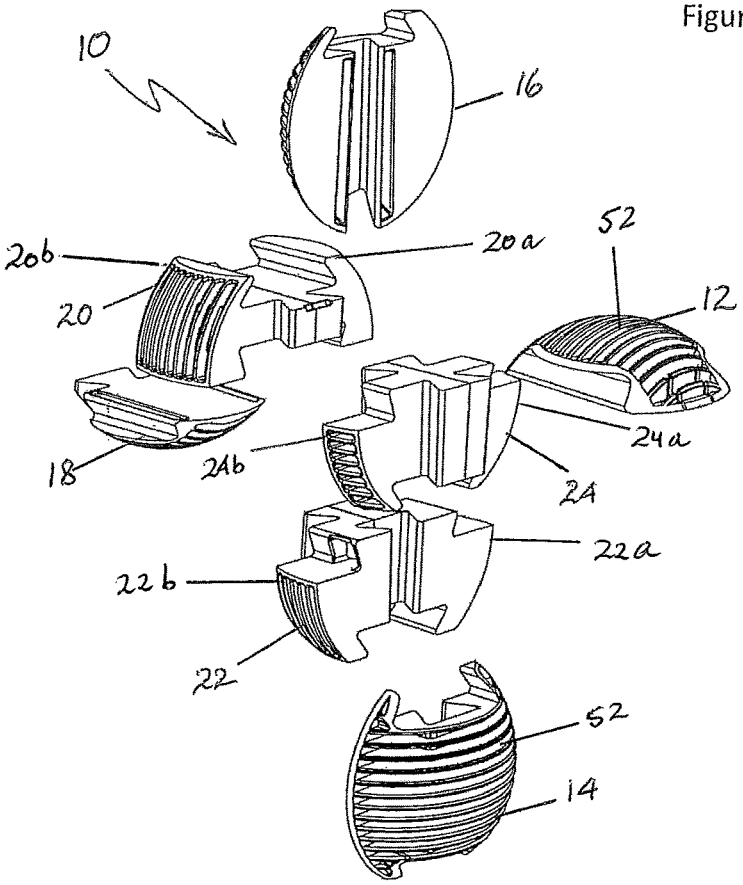
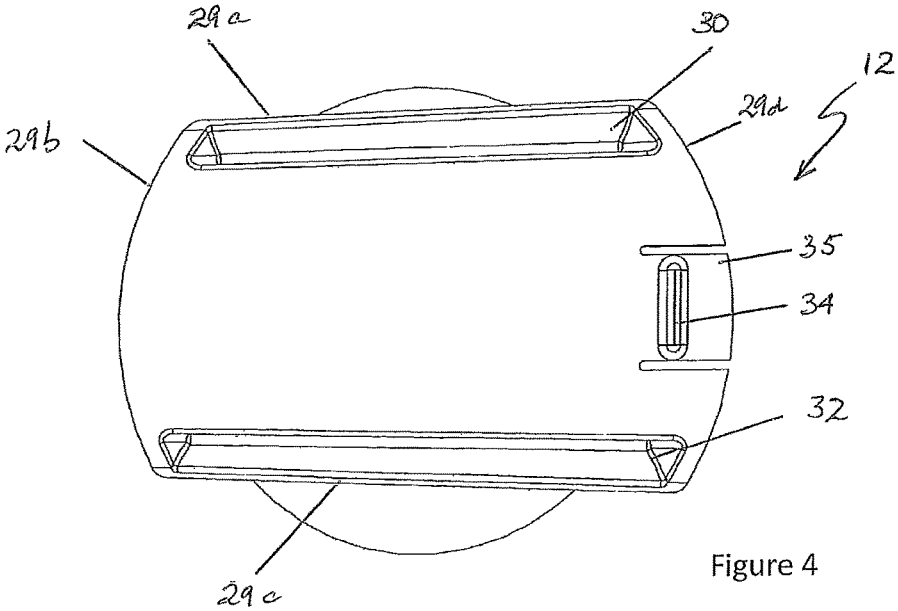
Figure 4

THREE DIMENSIONAL PUZZLE

CROSS REFERENCE TO RELATED APPLICATIONS

This application relates to and claims priority from Ser. No. PCT/AU2015/000479 filed Aug. 11, 2015, the contents of which are incorporated by reference which claims the priority of AU Patent Application Ser. No. 2014903133 filed on Aug. 11, 2014.

TECHNICAL FIELD

This invention relates to puzzles. More particular, the invention relates to three-dimensional puzzles where the completed puzzle has a three-dimensional shape, as opposed to a flat, planar shape.

BACKGROUND OF THE INVENTION

Three dimensional puzzles are well known. Some include a number of pieces, designed to fit together with a locking piece to hold all the pieces together.

Reference is made to International Patent Application PCT/AU94/00329 published as WO 95/34354 ('International Application'), the contents of which are incorporated herein by reference. The International Application disclosed a three-dimensional puzzle in which, broadly speaking, components interengaged with each other as the components were assembled, without requiring a final locking components as the sole means of holding the components together.

The present invention in its various aspects represents an improvement over the three-dimensional puzzle disclosed in the International Application.

SUMMARY OF THE INVENTION

Accordingly, in a first aspect, this invention provides a three dimensional puzzle having a plurality of three dimensional first components for engagement to form a three-dimensional finished shape, each of the three-dimensional first components being shaped for interlocking engagement with at least one other of the three-dimensional first components, wherein at least one of the three-dimensional first components is made in two parts adapted to be joined together by engagement different from the interlocking engagement.

In a second aspect, the invention provides a three-dimensional puzzle having a plurality of three dimensional first components for engagement to form a three-dimensional finished shape, each of the three-dimensional first components being shaped for interlocking engagement with at least one other of the three-dimensional first components, wherein the three-dimensional finished shape has an outer surface containing a three-dimensional pattern.

In a third aspect, the invention provides a three-dimensional puzzle having a plurality of three dimensional first components for engagement to form a three-dimensional finished shape, each of the three-dimensional first components being shaped for interlocking engagement with at least one other of the three-dimensional first components, wherein each component has a wall of substantially constant thickness.

In a fourth aspect, the invention provides a surround for a three-dimensional puzzle having a plurality of three-dimensional first components for engagement to form a three-dimensional finished shape, each of the three-dimensional first components being shaped for interlocking engagement with at least one other of the three-dimensional first components, wherein the surround is comprised of a plurality of second components, each of the second components being shaped for engagement with at least one other of the second components.

The various aspects of the invention may be used alone or in any combination with each other.

Unless otherwise indicated, the preferred embodiments described below apply to all aspects of the invention.

In each aspect of the invention, the three-dimensional puzzle may be made of any suitable material. However, for economy and precision, it is preferred that each first component is made from a suitable polymer plastic, such as ABS (acrylonitrile butadiene styrene).

It is particularly preferred that each first components is made by injection moulding, since this can provide a high volume process with tight tolerances. It is to be understood that the manufacture of the puzzle of the invention is not limited to injection moulding. Other methods such as casting, blow-moulding or roto-moulding, wire cutting from a solid form and 3D printing may also be suitable, for example.

Each second component is preferably made from a suitable polymer plastic, such as ABS, by injection moulding or other methods. However, it is also within the scope of this invention that each second component is made from other material, such as paper pulp (cardboard) rubber or silicon, for example.

The manner of interlocking engagement of the first components is preferably the same as or similar to that described in the International Application. For example, component 1 may engage with component 2 on first and second engagement surfaces, defining a third engagement surface. Component 3, having a fourth engagement surface, then engages the third engagement surface via the fourth engagement surface.

By 'interlocking engagement' is meant engagement in which each of two first components positively interlocks with the other, and does not include engagement by way of friction fit or use of adhesive or heat sealing.

It is preferred that the interlocking engagement of the first components includes a tongue and groove arrangement or other interlocking feature. It is further preferred that the tongue and groove or other interlocking feature, at least for chosen first components, is tapered to restrict manner of engagement, so that proper engagement can occur by sliding in one direction only, as opposed to sliding in either direction.

It is also preferred that at least two of the first components must be engaged before a third first component may be properly engageable. First components may have two or more t-shaped sections to act as tongues to interengage two or more separate first components.

In the first aspect, at least one of the three-dimensional first components is made in two parts adapted to be joined together by engagement different from the interlocking engagement. It is preferred that such a two-part first component is located wholly or partially internally of the puzzle, as a 'core' component. If desired, more than one of the first components may be made in two parts. It has been found that making one or more of the first components in two parts can enable cost efficiencies and accuracy in using injection moulding. An illustration is construction of undercut features of the first component or accuracy of interlocking engagement of the first components.

The two parts of such first component may be permanently joined, for example by adhesive, fasteners, ultrasonic welding or heat sealing. Alternately, the two parts may be joined so as to be separable, such as by using snap-fit or clip details that are incorporated into the moulded parts, or by friction fit, optionally using one or more male pegs or pins received within female cavities, or interlocking walls.

The two parts may be hollow to save on material. The hollow interior or internal cavity may be accessible by the user, as a secret compartment. As another option, the hollow interior may be used to house lights or sound emitting devices, for example, to add to enjoyment in use of the puzzle of the invention. The hollow interior or internal cavity may house a surprise gift, as another example.

In relation to the second aspect of the invention, the three dimensional pattern may be simply decorative and/or designed to aid manipulation of the puzzle first components. However, more preferably the three-dimensional pattern is intended to aid overmoulding or assist seating of the second components, in the fourth aspect of the invention.

The three-dimensional pattern may take any desired form. The pattern may be substantially constant over the outer surface or it may vary.

When the three-dimensional pattern is intended to aid overmoulding, it is preferred that the pattern includes a plurality of fins or support structures, having peaks and troughs to assist overmoulding and enable good bonding between the outer surface and the overmould. Other patterns are within the scope of the invention, such as hexagonal patterns, with the wall of each hexagon defining a recess.

By using overmoulding, the puzzle may be provided with a soft feel and finish. Overmoulding may provide an elastomeric coating over each first component having an external surface being part of the outer surface. Overmoulding may cover some or all of the outer surface of the puzzle, and may cover engaging surfaces if desired.

Overmoulding may also enhance the puzzle by giving it a resemblance to another product, such as a soccer ball or basketball, through either texturing the over-moulded material to reflect such resemblance, or by printing or painting the over-mould surfaces.

Overmoulding may be achieved using any suitable method and any suitable material. A non-limiting example includes injection moulding of an elastomeric resin onto the three-dimensional pattern, as coinjection or injection from separate injection points, so that the material of the first component bearing the pattern and the material of the overmould are shot, separately, into the same injection moulding tool, to produce a layered structure. Another example is the formation of the first component followed by movement of the first component to another mould cavity for overmoulding. Insert moulding may also be suitable.

The overmould may be melted onto the first component to effect bonding, assisted by the three-dimensional pattern on the outer surface of the three-dimensional puzzle.

The overmould material may be any suitable material, taking into account the material of the three dimensional puzzle. Examples are polypropylene based resins, thermoplastic polyurethane, styrene-ethylene/butylene-styrene copolymer, thermoplastic rubber, silicons and thermoplastic vulcanate.

According to the third aspect of the invention, each first component has a wall of substantially constant thickness. Preferably all walls of each first component are of substantially constant thickness. Further, it is preferred that all walls of each first component are of the same thickness as the walls of the other first components. Walls of constant thickness enhance manufacture, especially when injection moulding is used.

In the fourth aspect, the puzzle of the first, second and/or third aspects may be presented as a 'puzzle within puzzle', adding to enjoyment. The outer surface of the three-dimensional puzzle may be substantially smooth or it may have a three-dimensional pattern which can aid seating and/or retention of the second components to surround the three-dimensional puzzle.

The second components may be regular jig-saw shapes, being essentially two-dimensional, or they may be shaped in three dimensions to fit the outer surface of the three dimensional puzzle. For example, when the finished shape of the three dimensional puzzle has planar surfaces, the second components intended to surround such planar surfaces may be planar. Where the finished shape of the three-dimensional puzzle has curved surfaces, the second components intended to surround such curved surfaces may be curved, at least where contact is intended with the finished shape. It will be appreciated that the second components may have a first surface shape on their underside and a second surface shape on their external side.

Where the three-dimensional puzzle has a three dimensional surface pattern, the second components may have an underside shape for complementing that surface pattern. However, an unmatched or alternate puzzle shape can also be captured within the second components.

The second components may engage in any suitable way. Preferably, there is engagement between respective second components, as in a regular jigsaw or in a similar manner to the interlocking of the first components.

If desired, to add a degree of complexity and to cater for an internal cavity if present, the tongue and groove features of a second component need not traverse the entire cross section of the puzzle or of the component. For example, second component 1 may engage with part only of second component 2, with second component 3 engaging with part of second component 2.

Not all of the second components need have the same features as each other. For example, some second components may have an underside shape for complementing the surface pattern of the three-dimensional puzzle and some may not. Some or all second components may be solid and some may be of a skeletal form that encompasses part or all of the first components and thus provides access to the outer surface of the first components. It may be possible to view and/or touch the outer surface of first components through second components of a skeletal form.

BRIEF DESCRIPTION OF THE DRAWINGS

The invention in its various aspects will now be described in connection with non-limiting embodiments described in connection with the drawings. It will be appreciated that the drawings are not all shown on the same scale.

In the drawings:

FIG. 3 is an exploded view of the puzzle of FIGS. 1 and 2;

FIG. 4 is a plan view of the removed first component in FIG. 2, seen from below;

DETAILED DESCRIPTION OF THE DRAWINGS

Figure 1:
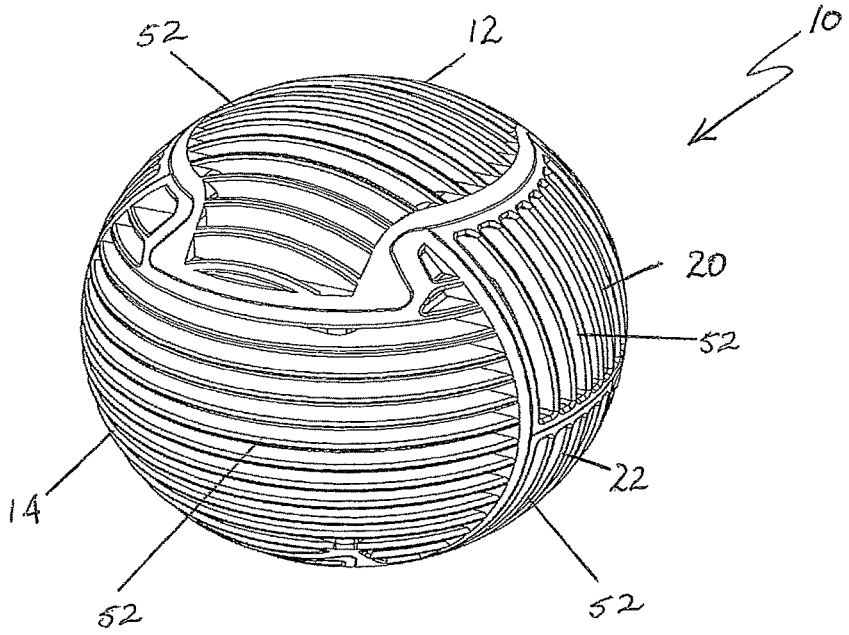
FIG. 1 is a perspective view of a first embodiment of the three-dimensional puzzle in its finished shape, being in the shape of a sphere, with a three-dimensional surface pattern.
Figure 2:
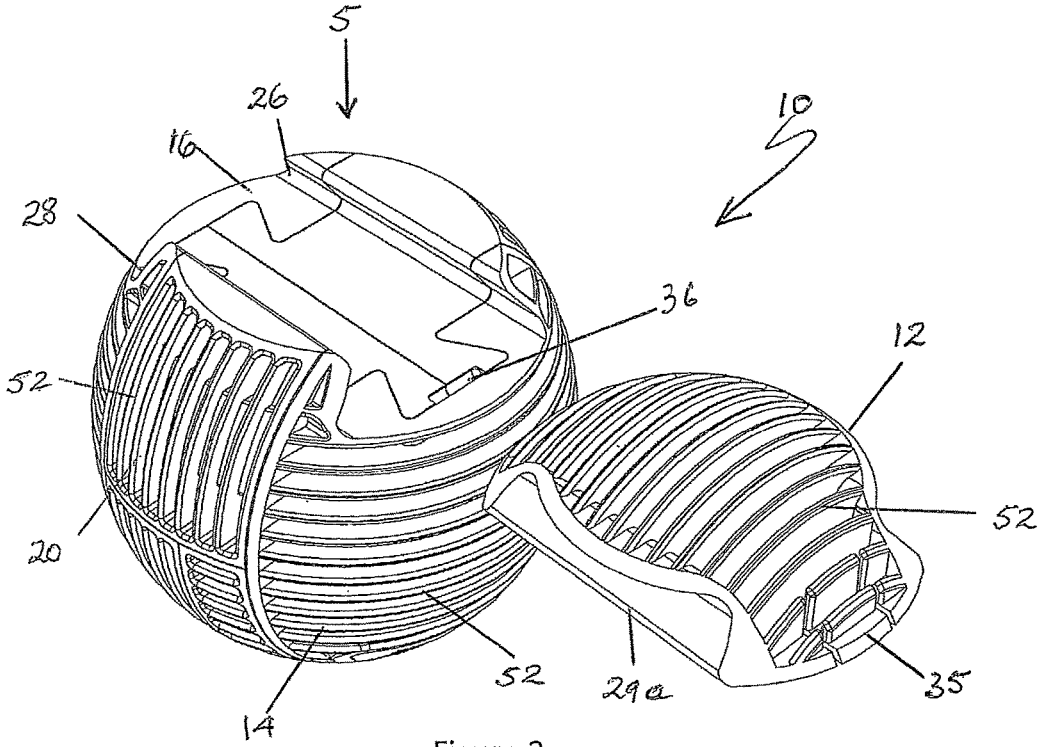
FIG. 2 shows the embodiment of FIG. 1, rotated to the right and showing removal of one first component.

Referring first to FIGS. 1 to 3, in this embodiment three dimensional puzzle 10 has seven first components 12, 14, 16, 18, 20, 22 and 24 for engagement to form the three-dimensional finished shape shown in FIG. 1. Each of first components 12, 14, 16, 18, 20, 22 and 24 is shaped for interlocking engagement with at least one other of the first components 12, 14, 16, 18, 20, 22 and 24, by sliding engagement of the tongue and groove type, as can be seen in FIGS. 2 and 3. Each of the first components is formed by injection moulding.

A detail of such tongue and groove engagement is seen in FIGS. 2 and 4. First component 20 as seen in FIG. 2 includes grooves 26 and 28. FIG. 4 shows on the underside of first component 12 edges 29*a*, 29*b*, 29*c* and 29*d*, forming a tongue, with sides 29*a* and 29*c* being inclined towards side 29*b*. Grooves 26 and 28 have a similar incline. Thus component 12 will fit properly into component 20 only if entry is as shown in FIG. 2, moving component 12 from right to left. Insertion in the opposite direction will not succeed, because of the tapered fit between components 12 and 20.

FIG. 4 shows recessed channels 30 and 32, which are formed during injection moulding to create the undercut nature of the interlocking tongue and groove.

As will be appreciated by one skilled in the art, a similar sliding engagement is used to engage first component 24 to first component 22, first component 20 to engaged first components 22 and 24, first component 18 to engaged first components 22 and 24, first component 16 to engaged first components 20 and 22, first component 14 to engaged first components 20 and 24 and first component 12 to engaged first components 16, 20 and 14.

Also shown in FIG. 4 is engaging clip 34, which is a protrusion on the underside of first component 12, on flexible finger 35, to engage notch or slot 36 in first component 20 (refer FIG. 2). Engaging clip 34 is an option to help hold puzzle 10 in the assembled form, but is not essential to hold all the first components together.

As an alternative to engaging clip 34 and slot 36, a small return wall (not shown) may be formed at much the same location on component 12 as engaging clip 34. The return wall may assist to hold puzzle 10 in the assembled form.

In this embodiment, three of the first components, namely 20, 22 and 24 (see FIG. 3) are each made in two parts and then joined together, as explained further in connection with FIGS. 5 and 6, below.

Figure 5:
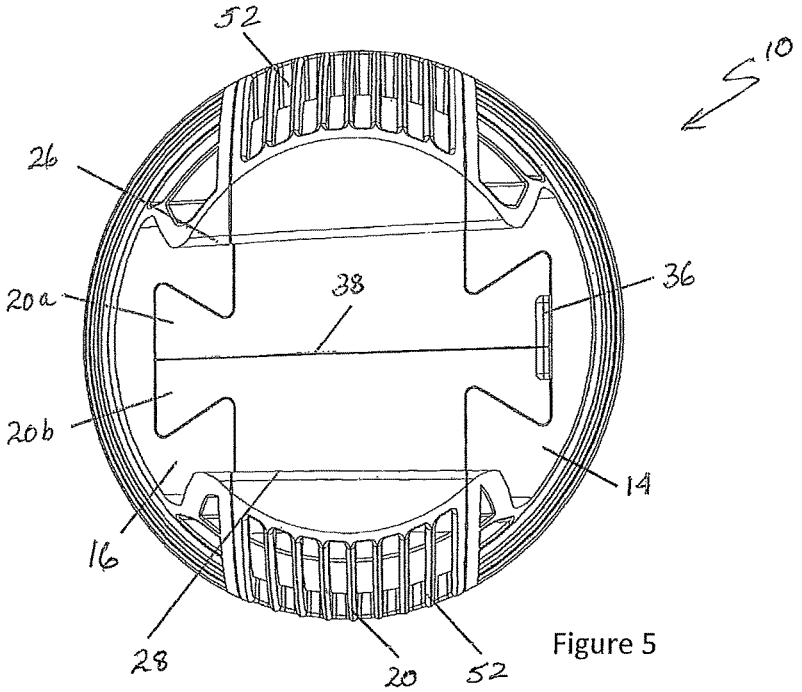
FIG. 5 is a plan view taken in the direction of arrow 5 in FIG. 2, illustrating an embodiment of engagement of tapering first components and also showing a first component made in two parts.
Figure 6:
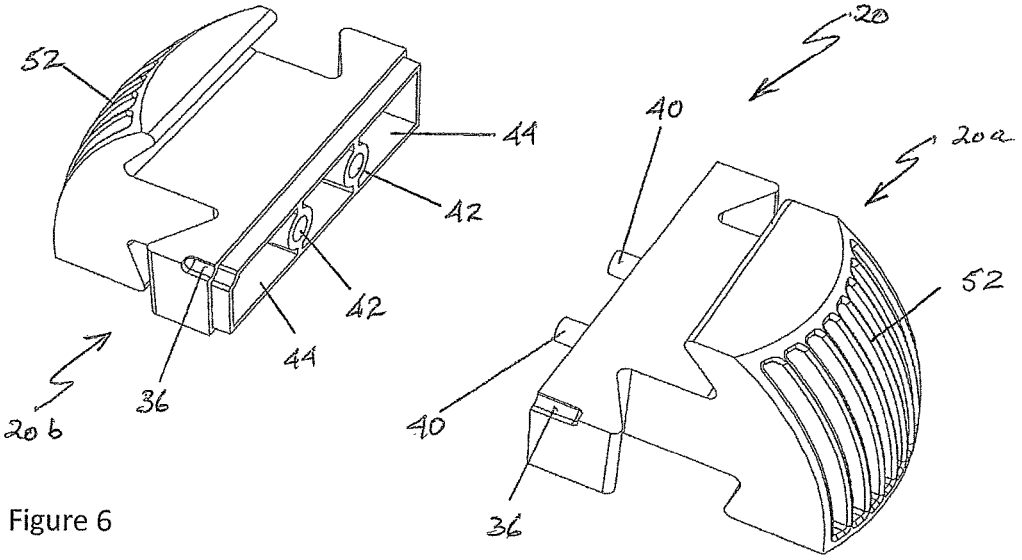
FIG. 6 is a perspective view of the two-part first component seen in FIG. 5, with the parts separated.

In FIG. 5, first component 20 has two parts, 20*a* and 20*b* joined at interface 38. While various methods of joining parts 20*a* and 20*b* may be employed, including permanent joining by adhesion, fasteners, ultrasonic welding or heat sealing, for example, in this embodiment, as shown in FIG. 6, pegs 40 fit through a friction fit into tubes 42 to form hollow cavity 44. Parts 20*a* and 20*b* may be pulled apart to overcome the frictional engagement of pegs 40 with tubes 42, to access hollow cavity 44.

Figure 7:
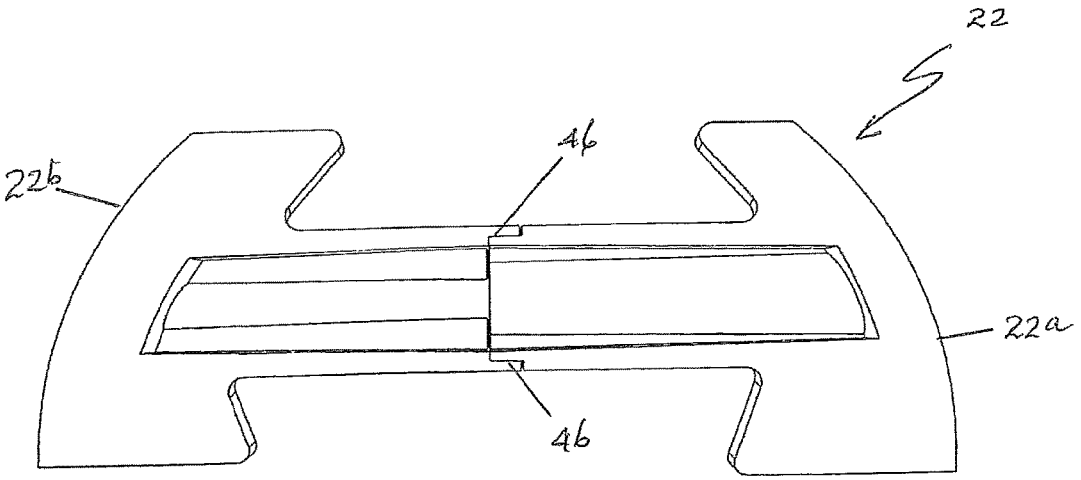
FIG. 7 is a sectional view of one of the first components seen in FIG. 3, illustrating a second two-part component.
Figure 8:
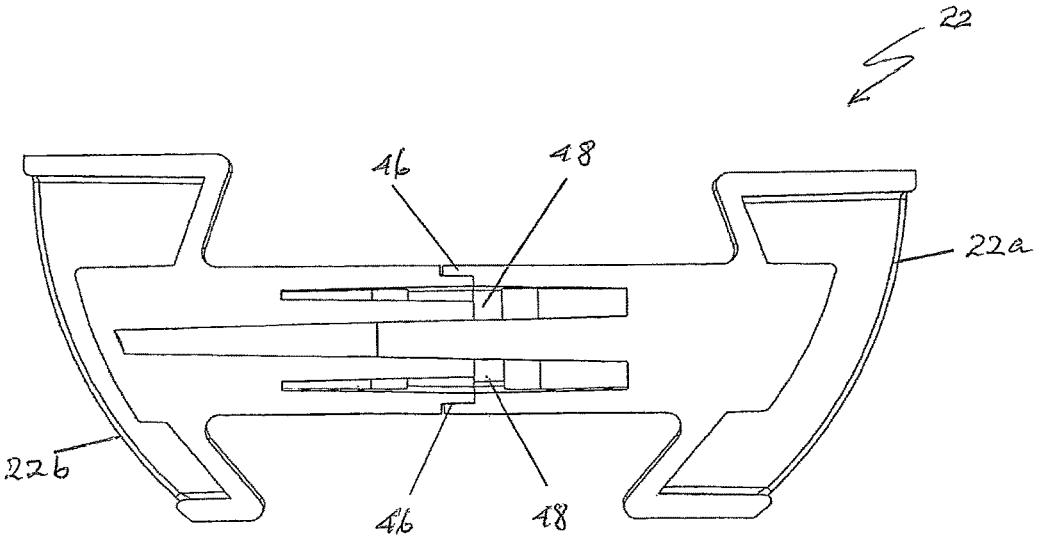
FIG. 8 is a sectional view of the second two-part component of FIG. 7 from below.

First component 22 is also made of two parts 22*a* and 22*b*, as shown in FIGS. 7 and 8, which are partial sectional views, omitting some of component 22 for simplicity of illustration. In this embodiment, there are dual methods of engagement: dovetailing of part 22*a* with part 22*b* at 46 and friction fit using pegs at 48.

Figure 9:
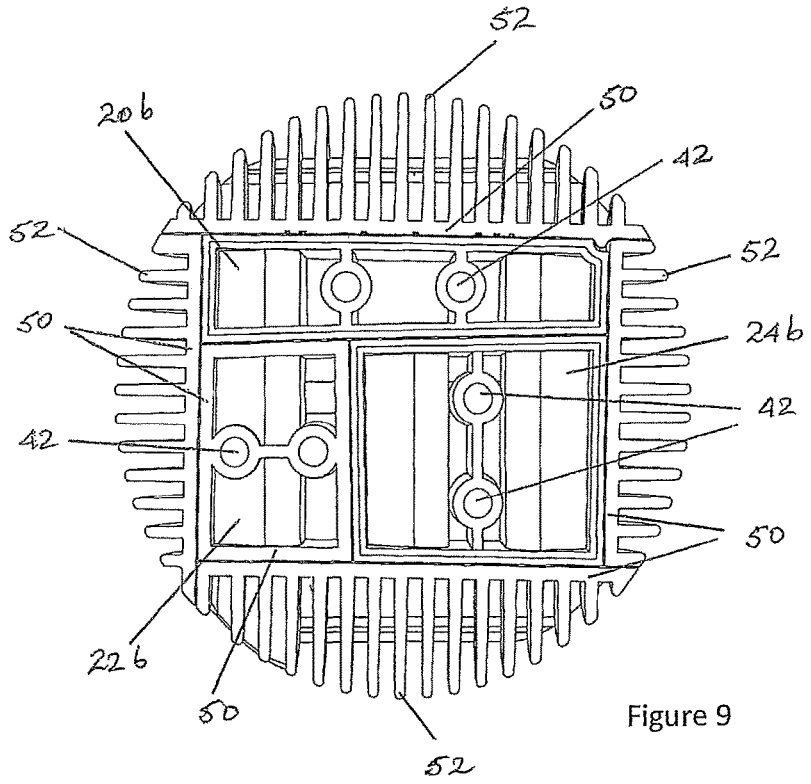
FIG. 9 is a sectional view of the first and second two part components of FIGS. 6 and 8 joined to a third two-part component.

Turning now to FIG. 9, this shows in partial section (with omissions for clarity) parts 20*b*, 22*b* and 24*b* of two-part components 20, 22 and 24 having tubes 42, only some of which are labelled. These tubes 42 are used to capture the friction fit pegs or pins 40 of parts 20*a*, 22 and 24*a* (not shown).

Figure 10:
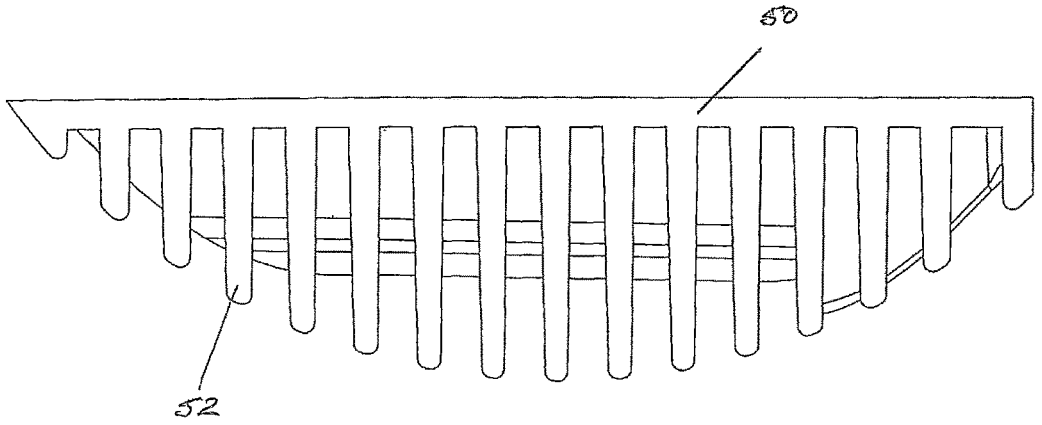
FIG. 10 illustrates an embodiment of a first component having a constant wall thickness and detailing a ribbed array of fins being an embodiment of part of a three-dimensional pattern on the outer surface.

FIG. 10 illustrates an embodiment of a first component having a wall 50 of constant thickness, to assist in injection moulding. As may be seen in FIG. 9, several or all the walls of the first components may be of constant thickness and further each of the first components may have a wall with the same thickness as that of a wall of the other first components.

Puzzle 10 is shown in each of FIGS. 1 to 3, 5, 6, 9 and 10 as having a three-dimensional surface pattern, in this embodiment taking the form of a plurality of arrays of fins 52.

Figure 11:
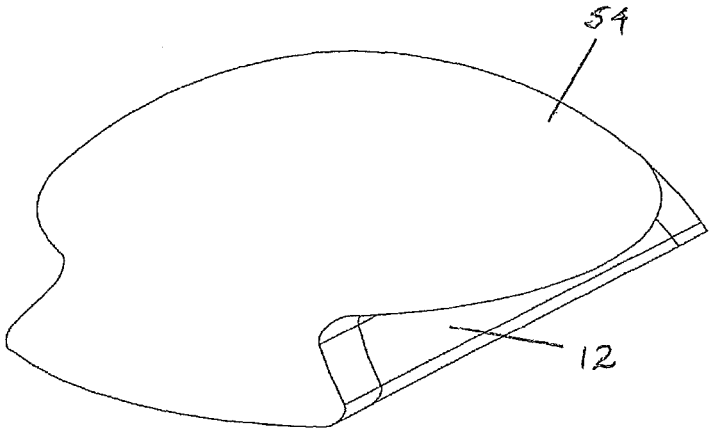
FIG. 11 shows an embodiment of overmoulding on the first component removed in FIG. 2.

FIG. 11 shows first component 12 after it has been overmoulded with an elastomeric resin 54. Component 12 is made of ABS or other injection mouldable polymers, while the overmould resin 54 is made of a suitable over-mouldable material such as silicon or rubber.

Resin 54 gives the surface of component 12 a soft feel, which is enhancing and which also assists manipulation during puzzle assembly. The compatibility between the material of component 12 and the resin 54 enables a good bond.

Figure 12:
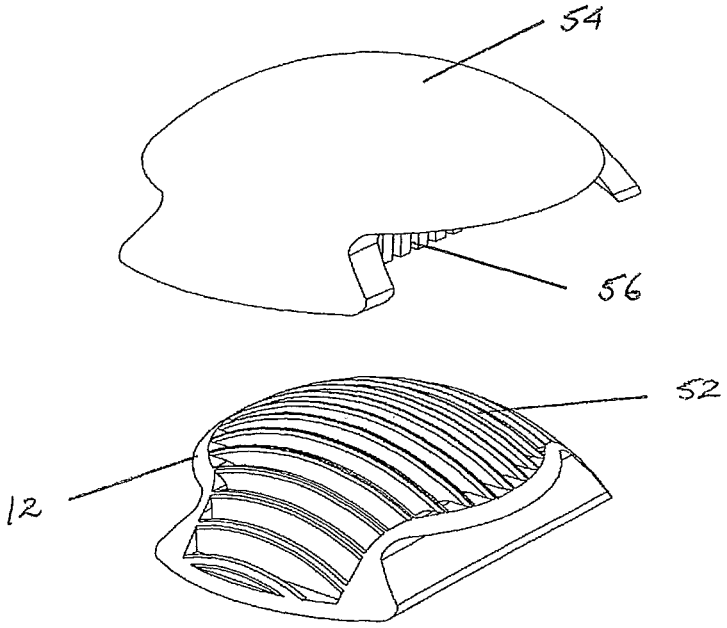
FIG. 12 shows an exploded view of the embodiment in FIG. 11.

FIG. 12 shows an exploded view of the embodiment in FIG. 11, but it is to be appreciated that this is for illustration purposes only: once the overmoulding has taken place, resin 54 cannot be disassembled from component 12 without damaging one or the other.

It can be seen from FIG. 12 that resin 54 has formed grooves 56 on its underside, complementing the array of fins 52, to further enhance bonding.

The other first components contributing to the outer surface of puzzle 10 may be overmoulded in the same way as component 12.

Figure 13:
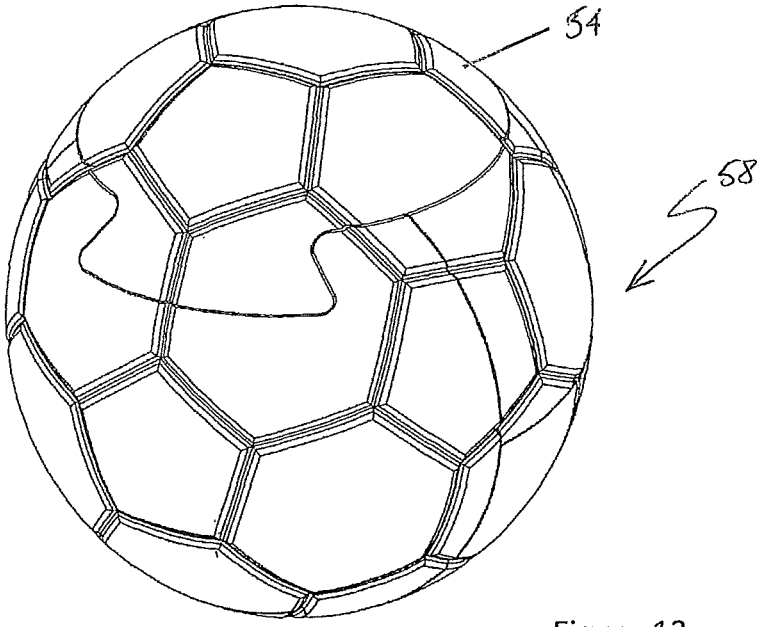
FIG. 13 is a perspective view of an assembled three dimensional puzzle with overmoulding textured to resemble a soccer ball.

The soccer design in FIG. 13 is an example of a textured appearance which can be achieved using overmoulding. The puzzle may be disassembled and assembled as usual.

Figure 14:
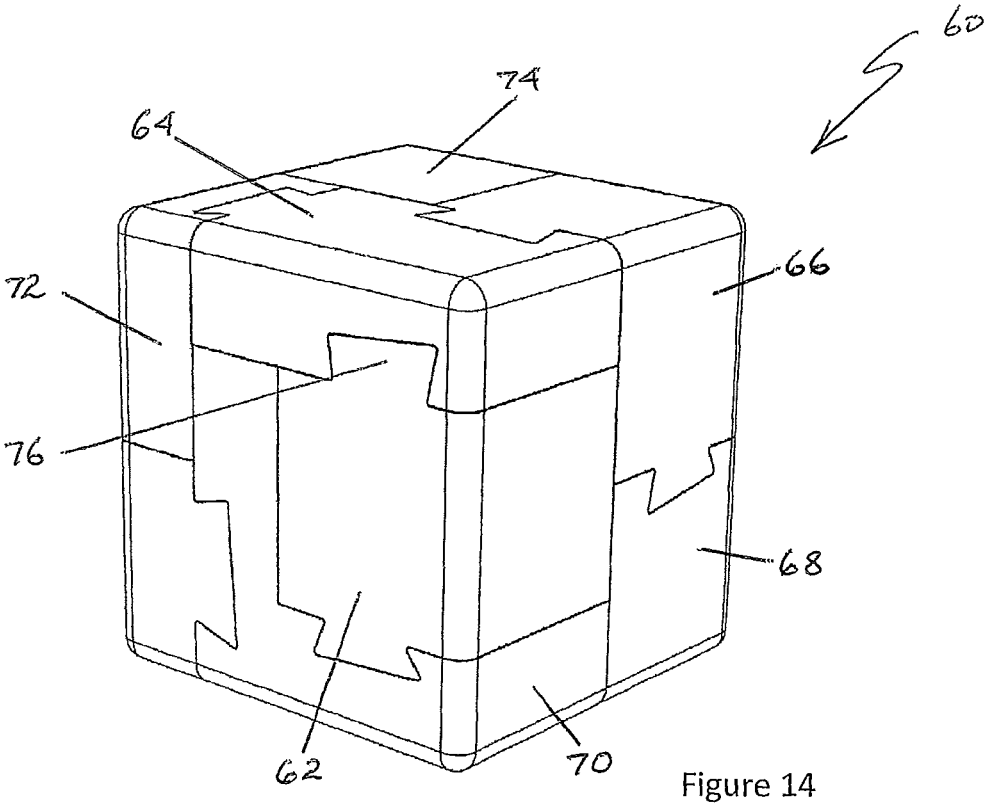
FIG. 14 is a perspective view of an embodiment of a surround about an assembled three-dimensional puzzle, the surround being in the form of a cube.
Figure 15:
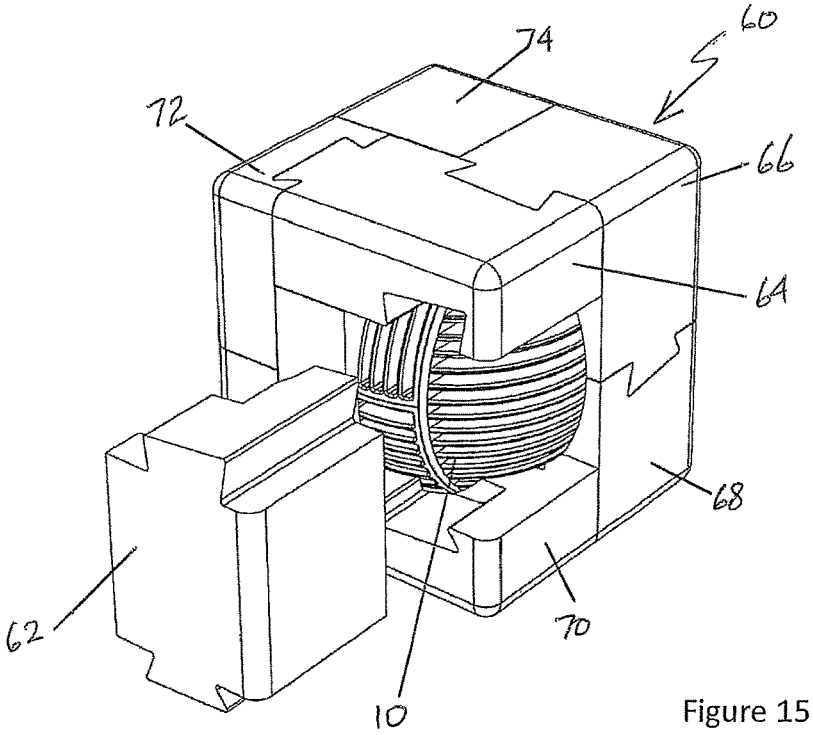
FIG. 15 shows the embodiment of FIG. 14, with one second component removed, revealing the three-dimensional puzzle inside.
Figure 16:
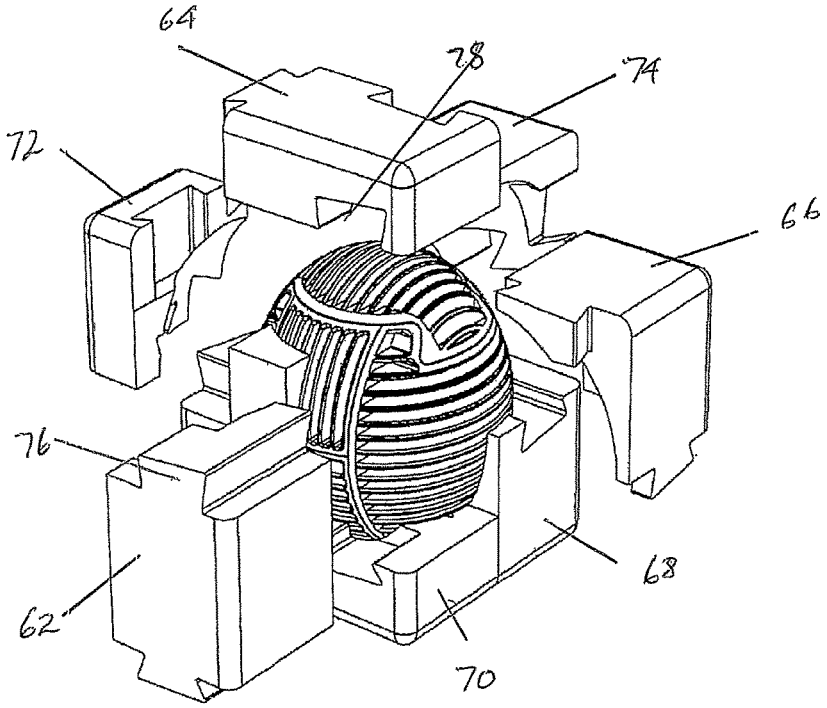
FIG. 16 is an exploded view of the embodiment in FIGS. 14 and 15.

A first embodiment of the surround of the fourth aspect of the invention is shown in FIGS. 14 to 16.

Three-dimensional puzzle 10 is surrounded by a cube 60 composed of a plurality of second components, some of which are labelled as 62, 64, 66, 68, 70, 72 and 74

Each of second components 62, 64, 66, 68, 70, 72 and 74 is shaped for engagement with at least one other of the second components. In this embodiment, the engagement occurs by sliding a tongue into a complementary groove, for example as shown by tongue 76 on second component 62 and groove 78 in second component 64.

The underside of each second component is shaped so as to fit snugly around puzzle 10, having appropriate curves. Optionally, the underside of each second component may have a surface complementing the fin arrays on the outer surface of puzzle 10.

Figure 17:
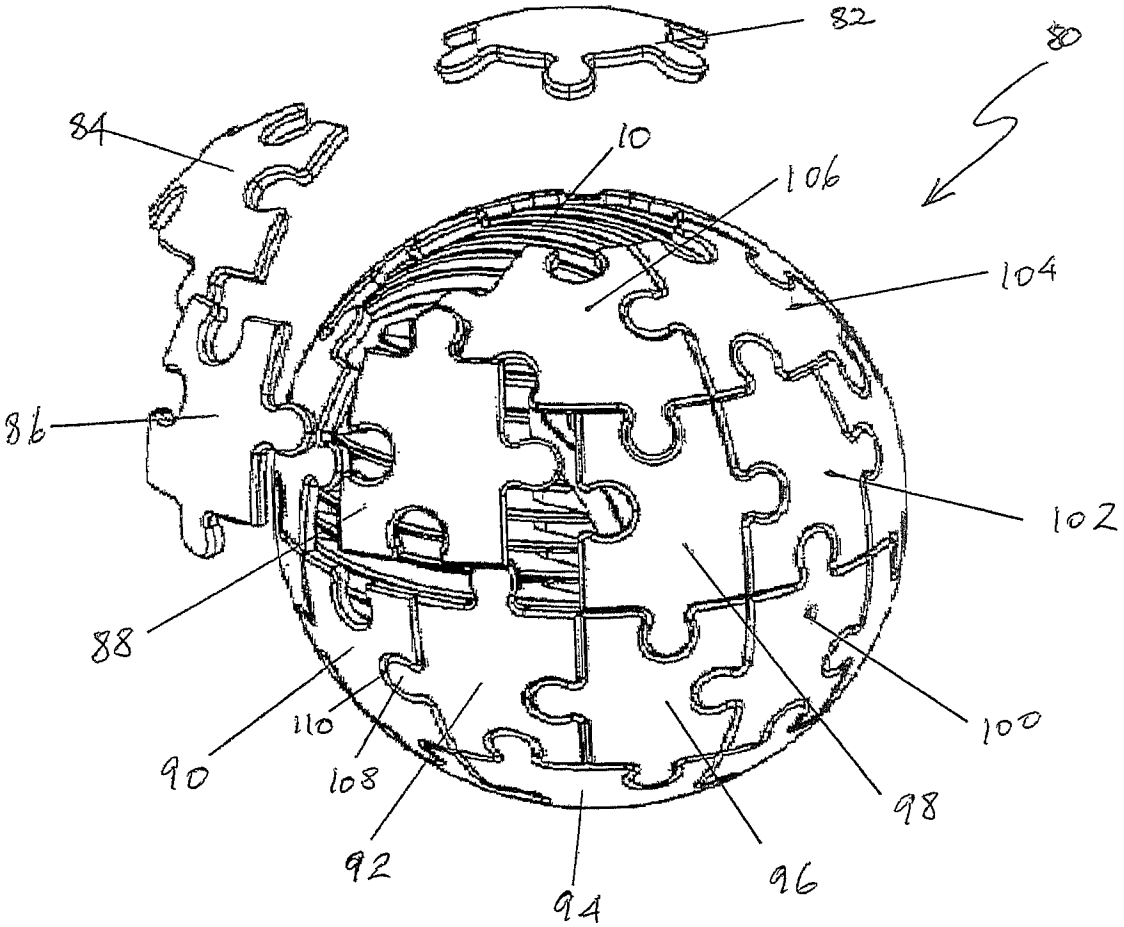
FIG. 17 is a partly exploded view of a second embodiment of a surround about an assembled three-dimensional puzzle, the surround being in the form of a sphere.

The second embodiment of the surround of the fourth aspect of the invention is shown in FIG. 17. Sphere 80 is composed of a plurality of second components, some of which are labelled as 82, 84, 86, 88, 90, 92, 94. 96, 98, 100, 102, 104 and 106. In this embodiment, the engagement occurs by inserting or sliding a tongue into a complementary shallow groove, for example as shown by tongue 108 on second component 92 and groove 110 in second component 90.

The underside of each second component is shaped so as to fit snugly around puzzle 10, having appropriate curves. Optionally, the underside of each second component may have a surface complementing the fin arrays on the outer surface of puzzle 10.

INDUSTRIAL APPLICABILITY

It will be appreciated by one skilled in the art that the present invention provides attractive yet effective advances in the art of three-dimensional puzzles.

The invention claimed is:

1. A three-dimensional puzzle, comprising:

a plurality of three-dimensional first components for engagement to form a three-dimensional finished shape, each of the three-dimensional first components comprising:

an underside with a first surface shape and an external side with a second surface shape different from that of the first surface shape, the underside being shaped for interlocking engagement with an underside of at least one other of the three-dimensional first components, wherein:

at least a first one of the three-dimensional first components includes an engaging clip that releasably engages a corresponding slot on a second one of the three-dimensional first components;

remaining ones of the other three-dimensional components are configured to be joined together by a sliding engagment with one another;

none of the undersides is an outer surface of the puzzle when in an assembled state;

at least one of the three-dimensional first components includes two parts that are joined together; and wherein the interlocking engagement includes a tongue and groove arrangement.

2. The puzzle of claim 1, wherein the interlocking engagement includes a tongue and groove arrangement, at least part of which has a taper to restrict manner of the interlocking engagement.

3. The puzzle of claim 1, wherein the two parts are permanently joined.

4. The puzzle of claim 1, wherein the two parts are reversibly joined.

5. The puzzle of claim 4, wherein the two parts when joined create a compartment.

6. The puzzle of claim 1, wherein each first component has a wall of substantially constant thickness.

7. The puzzle of claim 6, wherein all walls of each first component are of substantially constant thickness.

8. The puzzle of claim 6, wherein all walls of each first component are of substantially the same constant thickness as the walls of the other first components.

9. The puzzle of claim 1, wherein the outer surface of the three-dimensional finished shape contains a three-dimensional pattern.

10. The puzzle of claim 9, wherein the three-dimensional pattern is substantially constant over the outer surface.

11. The puzzle of claim 9, wherein the three-dimensional pattern includes a plurality of fins or support structures.

12. The puzzle of claim 9, which includes an overmoulding on the outer surface.

13. The puzzle of claim 1, which includes a surround which has a plurality of second components, each of the second components being shaped for engagement with at least one other of the second components.

14. The puzzle of claim 13, wherein each second component has a shape which is planar.

15. The puzzle of claim 13, wherein each second component has a shape which is curved.

16. The puzzle of claim 13, wherein each second component has an underside with a first surface shape and an external side with a second surface shape, the first surface shape being different from the second surface shape.

17. The puzzle of claim 16, wherein the first surface shapes of the underside of the second components together complement the second surface shapes of the external side of the first components.

18. The puzzle of claim 13, wherein the engagement of the second components is by interlocking.

19. A three-dimensional puzzle, comprising:

a plurality of three-dimensional components engagable to form said three-dimensional puzzle defining a finished assembly shape having an outer surface with an irregular-surface;

each of said three-dimensional components, further comprising:

an outer surface portion and an inner surface portion;

each said outer surface portion forms a part of said outer surface exposed in said finished assembly shape and has a part of said irregular-surface;

each said inner surface portion forms a continuous smooth-surface profile that does not include said irregular-surface and is not on said outer surface in said finished assembly;

each said inner surface portion further comprising:

at least one of a projecting male sliding geometry portion; and a receiving female sliding geometry portion on said smooth-surface profile;

at least two of said plurality of three-dimensional components assembled in combination;

at least two of said projecting male sliding geometry portions on respective said three dimensional components forming a combined male sliding portion;

at least two of said receiving female sliding geometry portions on respective said three dimensional components forming a combined female sliding geometry portion;

said combined male sliding portion in a sliding engagement with said combined female sliding geometry portion;

an engaging male clip portion on said ourter surface of at least one of said plurality of said three dimensional components;

said engaging male clip portion extending cantilevered from said one of said three-dimensional component;

a receiving female clip concavity portion on said inner surface of another of said plurality of said three dimensional components; and in said finished assembly shape said engaging male clip portion in a non-sliding spring-clip engagement with said receiving female clip concavity portion which is not one of said sliding engagements in said three-dimensional puzzle.

20. The three-dimensional puzzle of claim 19, wherein:

the combined male sliding portion forms a tongue; and the combined female sliding geometry portion forms a groove.

21. The three-dimensional puzzle of claim 19, wherein:

the at least two of said plurality of three-dimensional components are assembled in combination along a common combination-plane;

said first portion has a first lateral surface along said common combination-plane;

said second portion has a second lateral surface along said common combination-plane;

the first lateral surface has at least one receptacle, the second lateral surface has at least one projection;

the at least one projection being received within the at least one receptacle and thereby securing the first portion to the second portion with the first lateral surface and the second lateral surface along said common combination-plane.

22. The three-dimensional puzzle of claim 20, wherein:

the at least two of said plurality of three-dimensional components assembled in said combination with said finished assembly shape each respectively define one of a complementary pair of respective concave portions; and wherein said pair of respective concave portions define an inner compartment within said outer surface.

* * * * *